US006773202B2

(12) United States Patent
Hagen

(10) Patent No.: US 6,773,202 B2
(45) Date of Patent: Aug. 10, 2004

(54) DEVICE FOR COVERING SHAFTS

(76) Inventor: Peter Hagen, Unterdorf 35a, A-6068 Mils (AT)

( * ) Notice: Subject to any disclaimer, the term of this patent is extended or adjusted under 35 U.S.C. 154(b) by 0 days.

(21) Appl. No.: 10/415,518

(22) PCT Filed: Oct. 18, 2001

(86) PCT No.: PCT/AT01/00337

§ 371 (c)(1),
(2), (4) Date: Jun. 2, 2003

(87) PCT Pub. No.: WO02/36892

PCT Pub. Date: May 10, 2002

(65) Prior Publication Data

US 2004/0022579 A1 Feb. 5, 2004

(30) Foreign Application Priority Data

Oct. 31, 2000 (AT) ..... 1848/2000

(51) Int. Cl.[7] ..... E02D 29/14
(52) U.S. Cl. ..... 404/25; 52/20

(58) Field of Search ..... 404/25, 26; 52/19, 52/20

(56) References Cited

U.S. PATENT DOCUMENTS 4,466,219 A * 8/1984 Campolito ..... 52/20

FOREIGN PATENT DOCUMENTS

| | | |
|---|---|---|
| EP | 0 536 100 A | 4/1993 |
| SE | 398 904 B | 1/1978 |
| WO | WO 99 53148 A | 10/1999 |

* cited by examiner

*Primary Examiner*—Robert E. Pezzuto
*Assistant Examiner*—Alexandra K. Pechhold
(74) *Attorney, Agent, or Firm*—Dykema Gossett PLLC

(57) ABSTRACT

A device for covering shafts of manholes in roads, (3) which is slideably guided in a covering ring (2) that is rigidly fixed on the shaft (1) proper, and a retaining ring (4) for receiving the shaft cover positioned in the plane of the road surface (6). Flexible fastening and simple construction is obtained by mounting the retaining ring (4) on the tube (3) so as to be detachable, with a limited degree of movement.

12 Claims, 2 Drawing Sheets

DEVICE FOR COVERING SHAFTS

BACKGROUND OF THE INVENTION

The invention relates to a device for covering shafts or manholes in roads, including a tube which is slideably held in a covering ring that is rigidly fixed on the shaft proper, and a retaining ring mounted on the tube that will receive the shaft cover positioned in the plane of the road surface.

Conventional shaft covers for sewers etc. essentially consist of tubular elements with a frame on top, which will support a cover. In the case of rainwater drains the cover will have holes while in the case of sewers a sealing cover will be provided. The lower end of the shaft usually rests on the sewer conduit generally extending in horizontal direction. Due to temperature changes, especially freezing, and other factors in the road foundation horizontal and vertical movements will inevitably occur. Traffic on the road will also generate considerable loads. Conventional rigid shaft systems will not be able to follow these movements or will do so only to a limited, extent. This will lead to damaging of individual parts and to situations in which the shaft cover is no longer in the plane of the road surface, thus creating an obstacle and a source of danger for road traffic. Repair work and the exchange of parts will be relatively cost-intensive.

From WO 82/04276 an arrangement for a shaft cover is known, in which a frame part for the cover is anchored in an upper layer of the road foundation by means of a supporting element in the shape of a spherical cap. The under side of the frame part is provided with a sleeve extending downwards and loosely enveloping the shaft tube, such that a certain degree of axial movement is possible. Changes in the height of ground due to freezing may thus be at least partially compensated. However, if a shift in parallel with the road surface or an inclination occurs in addition to the changes in height, this cannot be compensated. Furthermore the tube may seize in the sleeve thus impeding the desired function.

From the applicants of WO 99/53148 a pertinent device is known which permits the adaptation of the shaft system to prevailing conditions, especially to the distance of the shaft proper from the road surface, by inserting intermediate rings. These individual rings may move against each other to a limited degree, such that certain movements of the road surface due to freezing etc. may be followed without damaging any parts. The system will also permit tilting of the topmost ring, which will be necessary when the road is inclined. Although this system perfectly fulfills all the requirements, it must be noted that it consists of a multitude of parts and is therefore costly.

AT 403 492 B shows a shaft cover in which a cover frame is fixed to a tube which is sealingly connected to the sewer proper. In this way it is possible to adapt the position and inclination of the frame carrying the cover to changes in the height of the road surface. If changes in the road surface due to maintenance work or freezing etc. cause the inclination of the frame to change, this will lead to a shift of the frame in the direction of the road surface, however, which shift is impeded by the frame being firmly anchored in the road surface. This will cause problems or breaking of the device.

It is the object of the present invention to avoid these disadvantages and to present a simplified solution having essentially the same functionality. In particular the system should be easy to manufacture and apply.

According to the invention this object is achieved by mounting the retaining ring on a tube in a detachable way and allowing it a certain degree of movement. The covering ring is rigidly attached to the topmost shaft ring. This rigid attachment may be effected by screwing or similar means, but in many cases it will be sufficient to simply place the covering ring on top of the shaft ring, since backfilling with earth or material of the road base will create sufficient pressure to keep it securely in place. Subsequently the tube is inserted into the covering ring, and thus into the interior of the shaft, as far as required. Since the retaining ring is movably attached on the tube, tilting movements due to inclination of the road surface may be compensated, thus increasing the flexibility and safety of the system. The essential point of the invention is that vertical adaptation can be achieved during construction as well as during operation by a relative movement of the tube against the covering ring, and that tilting movements and small vibrations due to traffic may be compensated by the flexible attachment of the retaining ring on the tube. The device according to the invention allows for independent changes both in height and inclination, both during work on the road, such as surface renewal, and in current operation when freezing or thermal expansion occurs.

It is of particular advantage if the retaining ring is tiltable against the tube, such that the axes of the retaining ring and the tube enclose a small angle in the tilted position. In particular it is provided that the angle between the axis of the retaining ring and the axis of the tube should not be greater than 20°, and preferably not more than 10°. In this way the usually occurring inclinations or tilts can be securely compensated.

The shaft cover may reliably and permanently be kept in the plane of the road surface if the retaining ring is provided with a supporting face which is to be positioned on the road base. In addition, the retaining ring may be provided with anchoring elements for fixing it in the road build-up.

A particularly advantageous variant of the invention provides that the tube is furnished with a number of anchors which are attached to the retaining ring in a manner permitting some play. It is of advantage if the anchor can be fastened or released by rotating the retaining ring relative to the tube. The fastening is thus effected by a kind of modified bayonet catch.

The entry of undesirable external water may reliably be avoided by furnishing the inner diameter of the covering ring with a seal acting against the outer periphery of the tube.

Installation of the device according to the invention is facilitated by press fitting the covering ring on the tube. In this case the covering ring is mounted on the tube prior to installation and is kept in place by the press fit. During assembly the end of the tube is inserted into the topmost shaft ring until the covering ring rests against the top face of the topmost shaft ring. The covering ring will thus keep the tube in place and will keep it from slipping down into the shaft ring. In this situation the surrounding region of the tube can be filled with material of the road base, securing the covering ring on the shaft and providing axial guidance for the tube. By applying sufficient force to overcome the holding force of the covering ring and the surrounding material the tube may be shifted downwards. After placement of the retaining ring the road surface may be built flush with the upper edge of the retaining ring. The procedure described is particularly simple and not prone to failure. Preferably the covering ring and the tube are made of plastic material; choice of a suitable plastic material for the covering ring may eliminate the need for a separate seal against the tube and thus reduce cost.

In order to better guide the retaining ring on the tube and to enhance ease and safety of installation the retaining ring may be provided with a collar enveloping the tube. In this way sand or dirt may be prevented from penetrating between retaining ring and tube.

BRIEF DESCRIPTION OF THE DRAWING

The invention will be explained in further detail below with reference to the following figures.

DETAILED DESCRIPTION OF THE PREFERRED EMBODIMENTS

Figure 1:
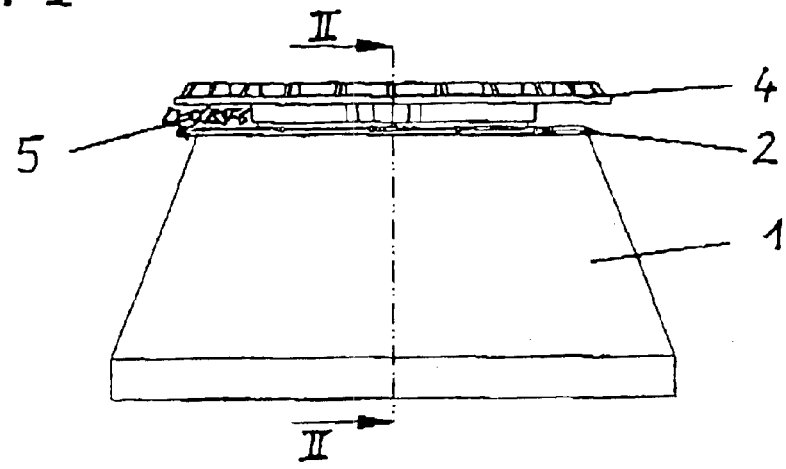
FIG. 1 is a lateral view of a device according to the invention in the fully assembled state.

FIG. 1 shows a shaft 1 carrying a device according to the invention, which device includes a covering ring 2, a tube 3 and a retaining ring 4. The covering ring 2 is placed on the front face of shaft 1 and fixed in position by material of the road base indicated by 5. The retaining ring 4 is flush with road surface 6 and may receive a shaft cover not, shown.

Figure 2:
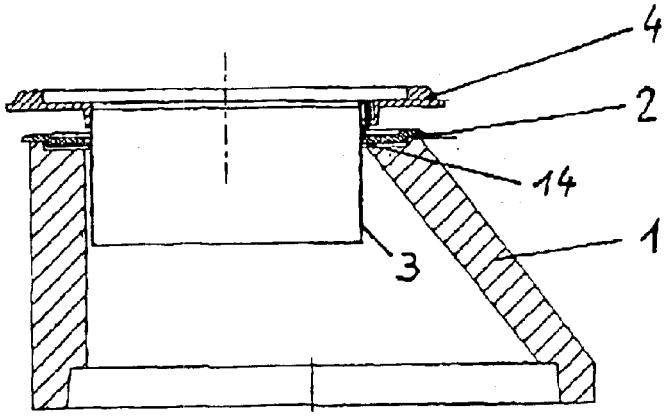
FIG. 2 is a sectional view along line II—II of FIG. 1.
Figure 3:
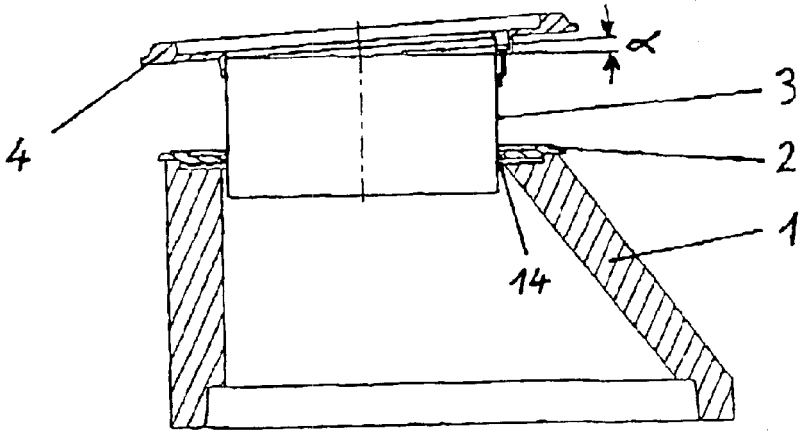
FIG. 3 is a section as shown in FIG. 2 with the retaining ring tilted.

FIG. 2 shows a situation immediately after installation of the device and before backfilling with road base material. The tube 3 is held by the covering ring 2 due to friction, and the retaining ring 4 rests on the tube 3 and is in its lowest position. FIG. 3 shows the retaining ring 4 in a tilted position against tube 3 whereby inclinations of the road surface 6 may be taken into account. The retaining ring 4 may also be lifted as a whole relative to tube 3 in order to have leeway in the building of the road surface 6. In the position shown in FIG. 3 the axis 4*a* of the retaining ring 4 encloses an angle $\alpha$ of about 3° with the axis 3*a* of the tube 3.

Figure 4:
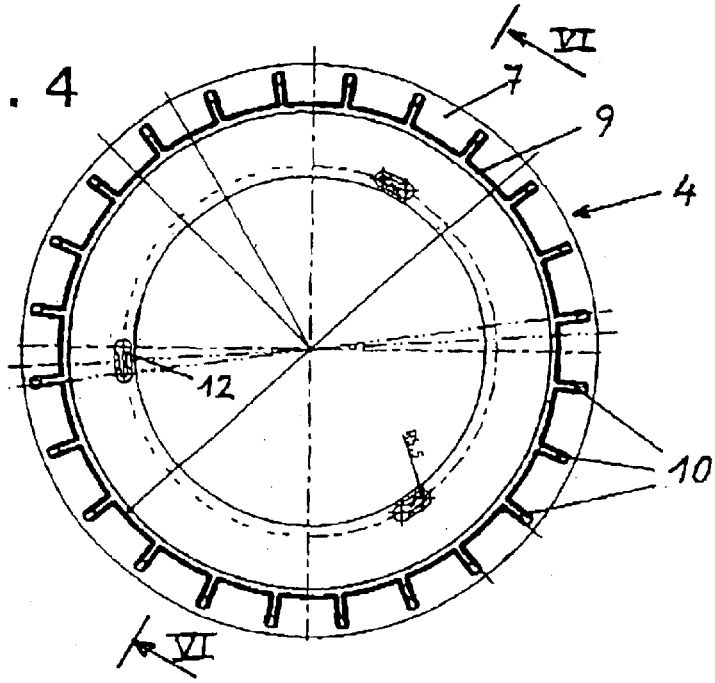
FIG. 4 is a view of the retaining ring from above.
Figure 5:
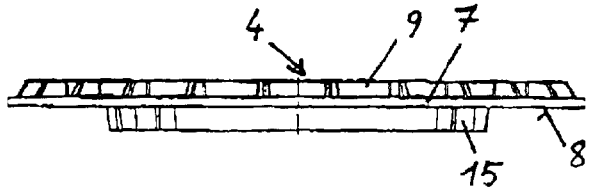
FIG. 5 is a lateral view of the retaining ring.
Figure 6:
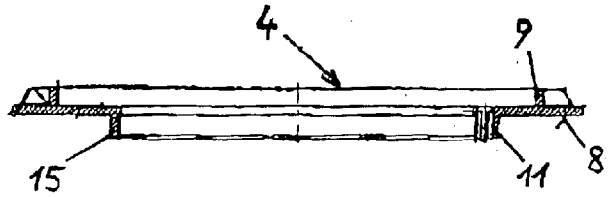
FIG. 6 is a section along line VI—VI in FIG. 4.
Figure 7:
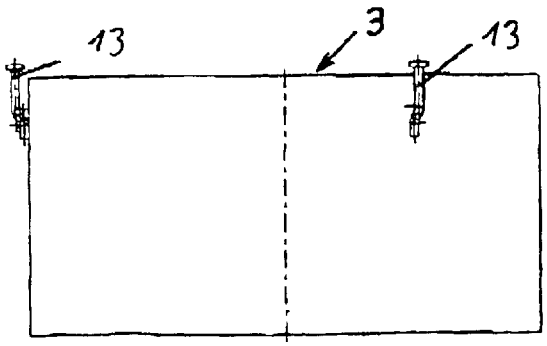
FIG. 7 is a lateral view of the tube.
Figure 8:
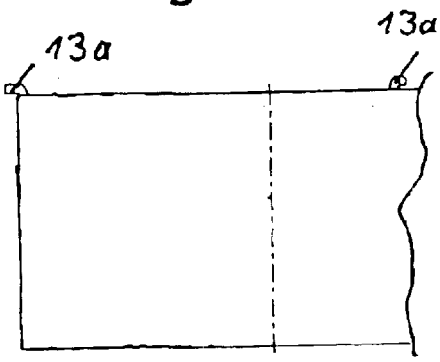
FIG. 8 is a lateral view of the tube in a further variant of the invention.

FIG. 4 shows the retaining ring 4 with a flange 7 whose underside is provided with a surface 8 upon which the ring rests. From the flange 7 a ring 9 extends upwards which is used to center a cover (not shown) or a cover frame and is supported by exterior ribs 10. The retaining ring 4 is provided with cages 11 at regular intervals along a circle, each of which cages 11 has a slot 12 for fastening the tube 3. FIG. 7 shows that the tube 3 carries anchors in the form of bolts 13 which are to be inserted in the slots 12. In this way the retaining ring 4 is fastened to the tube 3 with a limited degree of movability. In the variant of FIG. 8 hooks 13*a* are provided instead of the bolts 13, which engage in recesses of the retaining ring 4 not shown in the drawing. This will prevent cages 11 from presenting an obstacle during installation.

The covering ring 2 and the tube 3 are made from plastic, the fit at the site of contact 14 being a press fit, which means that the tube 3 may be shifted against the covering ring 2 only by the application of a force exceeding the total weight of the device. In this way it is guaranteed that the device is stable during installation.

The retaining ring 4 is further provided with a collar 15 extending downwards from the bearing surface 8, which envelops the tube 3 with some play thus guiding and centering the tube.

The present invention is particularly well suited for the covering of sewer shafts in difficult situations, e.g. in roads with high traffic load, strong temperature fluctuations, etc. It is obvious that the invention will not be limited to road-related applications but may be of use also in other contexts.

What is claimed is:

1. Device for covering shafts or manholes in roads, comprising a tube which is slideably held in a covering ring that is rigidly fixed on the shaft proper, and a retaining ring mounted on the tube that will receive a shaft cover positioned in a plane of a surface of the road, said tube including a plurality of anchors for mounting the retaining ring thereon with a limited degree of play.

2. Device according to claim 1, wherein the retaining ring is tiltable relative to the tube, such that the axes of the retaining ring and the tube enclose a small angle $\alpha$ in the tilted position.

3. Device according to claim 2, wherein the angle $\alpha$ between an axis of the retaining ring and an axis of the tube does not exceed 20°.

4. Device according to claim 3, wherein the angle $\alpha$ between an axis of the retaining ring and an axis of the tube does not exceed 10°.

5. Device according to claim 1, wherein the retaining ring is provided with a supporting face which is to be positioned on a base of the road.

6. Device according to claim 1, wherein the retaining ring is provided with anchoring elements for affixing in a build up of the road.

7. Device according to claim 1, wherein the anchors may be fastened or released by rotating the retaining ring relative to the tube.

8. Device according to claim 1, wherein the inner diameter of the covering ring is provided with a seal acting against an outer periphery of tube.

9. Device according to claim 1, wherein the covering ring is mounted on the tube by a press-fit.

10. Device according to claim 1, wherein the covering ring is made in one piece of plastic material.

11. Device according to claim 1, wherein the tube is made of plastic material.

12. Device according to claim 1, wherein the retaining ring is provided with a collar enveloping the tube.

* * * * *